US011649758B1

(12) United States Patent
Kareemullah et al.

(10) Patent No.: US 11,649,758 B1
(45) Date of Patent: May 16, 2023

(54) SYSTEMS AND METHODS FOR CONTROL OF ENGINE COOLING

(71) Applicant: Caterpillar Inc., Peoria, IL (US)

(72) Inventors: Shah S. Kareemullah, Dunlap, IL (US); Anthony L. De Luca, Germantown, IL (US); Christiana G. Aguirre, Peoria, IL (US); Scott R. Schuricht, Princeville, IL (US); Joseph L. Kennedy, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/664,384

(22) Filed: May 20, 2022

(51) Int. Cl.

| | |
|---|---|
| ***F01P 7/14*** | (2006.01) |
| ***F01P 5/10*** | (2006.01) |
| ***F01P 3/20*** | (2006.01) |
| ***F02M 31/20*** | (2006.01) |
| ***F01P 7/16*** | (2006.01) |

(52) U.S. Cl.
CPC ..... *F01P 7/14* (2013.01); *F01P 3/207* (2013.01); *F01P 5/10* (2013.01); *F01P 7/165* (2013.01); *F02M 31/20* (2013.01); *F01P 2007/146* (2013.01); *F01P 2025/13* (2013.01); *F01P 2025/60* (2013.01)

(58) Field of Classification Search
CPC ..... F01P 7/14; F01P 3/207; F01P 5/10; F01P 2007/146; F01P 2025/13; F01P 2025/60; F01P 7/165; F02M 31/20
See application file for complete search history.

(56) References Cited

U.S. PATENT DOCUMENTS

| | | | | |
|---|---|---|---|---|
| 4,325,219 | A | 4/1982 | Stang et al. | |
| 4,520,767 | A | 6/1985 | Roettgen et al. | |
| 5,121,714 | A | 6/1992 | Susa et al. | |
| 5,295,880 | A | 3/1994 | Parker | |
| 6,554,664 | B1 | 4/2003 | Nanami | |
| 6,821,171 | B1 * | 11/2004 | Wynveen | B63H 21/38 123/41.82 R |
| 6,851,992 | B2 | 2/2005 | Matsuo | |
| 7,086,370 | B2 | 8/2006 | Yonezawa et al. | |
| 7,137,364 | B2 | 11/2006 | Takahashi | |
| 7,264,520 | B1 * | 9/2007 | Taylor | F01P 11/08 440/88 HE |
| 7,543,558 | B2 | 6/2009 | Buck | |
| 7,717,069 | B2 | 5/2010 | Mokire et al. | |
| 10,018,103 | B2 | 7/2018 | Ito et al. | |
| 2013/0255598 | A1 | 10/2013 | McConville | |

FOREIGN PATENT DOCUMENTS

| | | | |
|---|---|---|---|
| JP | 2005036731 | A | 2/2005 |

* cited by examiner

*Primary Examiner* — Jacob M Amick
(74) *Attorney, Agent, or Firm* — Bookoff McAndrews, PLLC

(57) ABSTRACT

A method for controlling an internal combustion engine cooling system includes pumping coolant in an engine cooling loop with a coolant pump, pumping the coolant in an air cooler loop that includes a liquid-to-liquid heat exchanger with the coolant pump, and receiving a condition signal indicative of at least one condition associated with the internal combustion engine. The method also includes, based on the condition signal, adjusting a position of a flow control valve to modify a flow of coolant to the liquid-to-liquid heat exchanger.

20 Claims, 4 Drawing Sheets

SYSTEMS AND METHODS FOR CONTROL OF ENGINE COOLING

TECHNICAL FIELD

The present disclosure relates generally to methods and systems for internal combustion engine systems and, more particularly, to systems and methods for an internal combustion engine system with an air cooler.

BACKGROUND

Internal combustion engines are useful in various applications, including in machines, marine applications, and vehicles. These internal combustion engines generate significant quantities of heat during operation. To control this heat, engines are typically coupled to a cooling system that supplies coolant to the interior of the engine with the goal of maintaining the engine at suitable operating temperatures. In high-output internal combustion engine systems, cooling can also be provided to components other than the engine itself, such as air-supply components. These compressed-air cooling devices, such as aftercoolers, can reduce the temperature of air and further improve the efficiency and/or output of the engine.

Cooling systems for internal combustion engines include passages for circulating liquid coolant where needed. For example, engine systems for marine applications can include plural individual loops, each loop including a dedicated coolant-supplying pump. Thus, these systems include one pump that supplies coolant for the engine itself, and another pump that supplies coolant for another component of the engine system, such as an intercooler. While these systems can provide sufficient cooling capacity under some operating conditions, the use of separate individual pumps and fully-isolated loops involves the use of significant space and cost. For example, engine systems with multiple coolant loops employ mechanisms that transfer power from the engine to the coolant pumps, each coolant loop having a dedicated pump. However, some engines with space and/or design constraints are unable to accommodate individual engine-driven pumps. Even when engines systems are designed to accommodate individual coolant loops with separate pumps, the use of a dedicated pump for each loop increases the cost, size, and complexity of the system, while reducing efficiency due to increased parasitic load to drive each individual pump.

An engine system is described in U.S. Pat. No. 7,543,558 ("the '558 patent") to Buck. The system described in the '558 patent includes a primary water pump that circulates water for cooling cylinders of an internal combustion engine, as well as a raw water pump for pumping from a body of water. The system of the '558 patent includes multiple open flow paths for the raw water pump. While the system described in the '558 patent may be useful for providing adequate engine cooling under some circumstances, it is not able to adjust a flow of coolant to a heat exchanger based on changing engine conditions.

The systems and methods of the present disclosure may solve one or more of the problems set forth above and/or other problems in the art. The scope of the current disclosure, however, is defined by the attached claims, and not by the ability to solve any specific problem.

SUMMARY

In one aspect, a method for controlling an internal combustion engine cooling system may include pumping coolant in an engine cooling loop with a coolant pump, pumping the coolant in an air cooler loop that includes a liquid-to-liquid heat exchanger with the coolant pump, and receiving a condition signal indicative of at least one condition associated with the internal combustion engine. The method may also include, based on the condition signal, adjusting a position of a flow control valve to modify a flow of coolant to the liquid-to-liquid heat exchanger.

In another aspect, a method for controlling a cooling system for an internal combustion engine may include pumping coolant in a first closed loop and a second closed loop, the first and second closed loops being connected to each other and to a single coolant pump, the first closed loop including an air cooler and determining a condition associated with the internal combustion engine, including one or more of an engine speed condition, an engine output condition, an ambient temperature condition, or an emissions condition. The method may also include, in response to the determined condition, adjusting a position of a coolant flow valve positioned in the first closed loop.

In yet another aspect, an internal combustion engine cooling system may include an internal combustion engine, a single coolant pump in fluid communication with an engine cooling loop connected to provide coolant to the internal combustion engine and an air system cooling loop connected to provide the coolant to an air cooler, and a liquid-to-liquid heat exchanger configured to receive the coolant via the coolant pump. The system may also include a flow control valve connected downstream of the coolant pump as part of the air system cooling loop, the flow control valve being configured to modify a flow of the coolant from the engine cooling loop to the liquid-to-liquid heat exchanger based on one or more operating conditions of the internal combustion engine.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a method or apparatus that comprises a list of elements does not include only those elements, but may include other elements not expressly listed or inherent to such a method or apparatus. In this disclosure, relative terms, such as, for example, "about," "substantially," "generally," and "approximately" are used to indicate a possible variation of ±10% in the stated value or characteristic. While the term "seawater" is used herein for convenience, "seawater" is intended to encompass both saltwater (e.g., ocean water) and freshwater (e.g., lake water, river water, etc.). As used herein, "coolant" excludes seawater, but includes any suitable cooling fluid, such as fresh water (e.g., deionized water), propylene glycol, ethylene glycol, and others, including mixtures.

Figure 1:
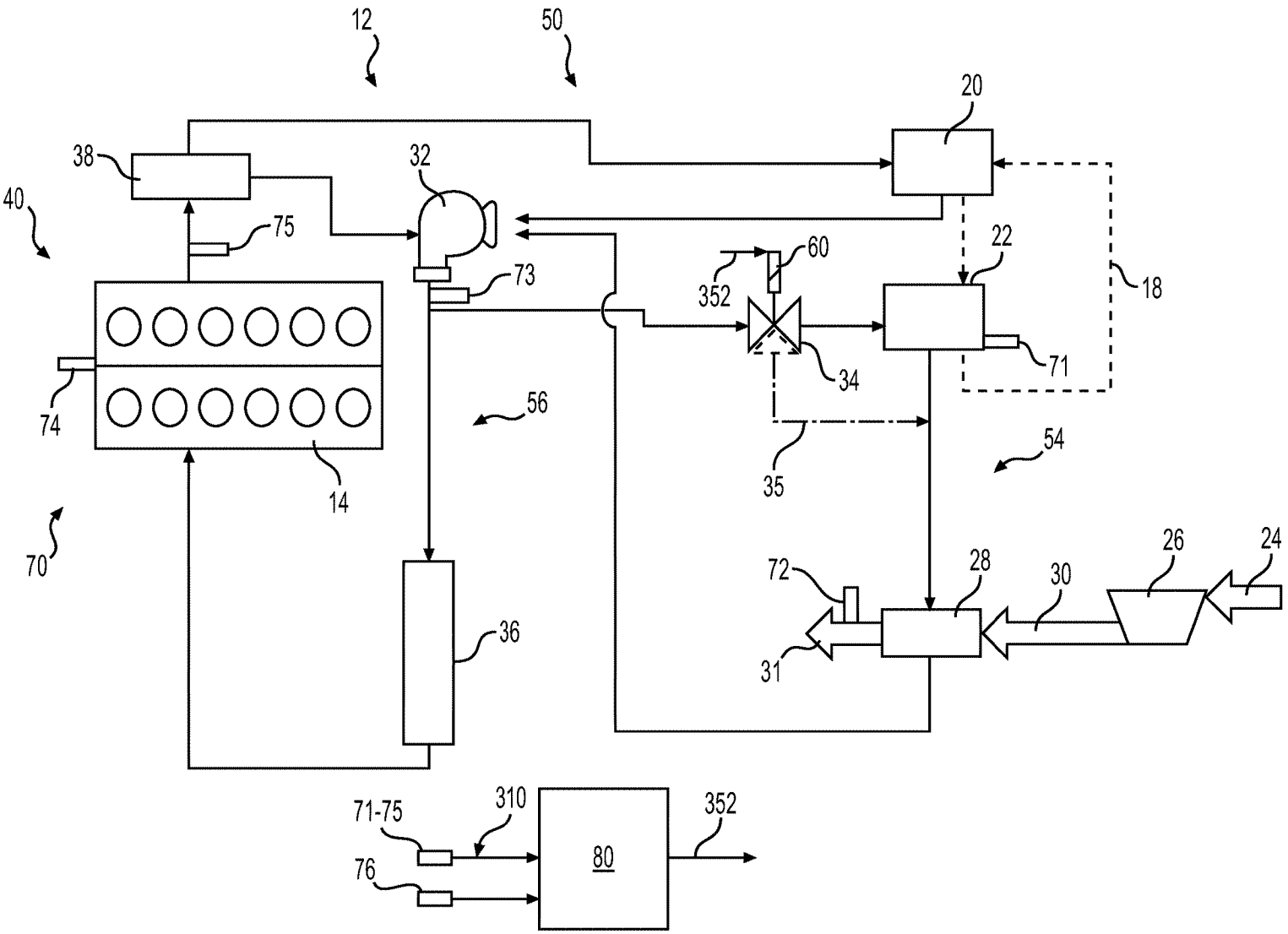
FIG. 1 is a schematic diagram of an engine system, according to aspects of the disclosure.
Figure 2:
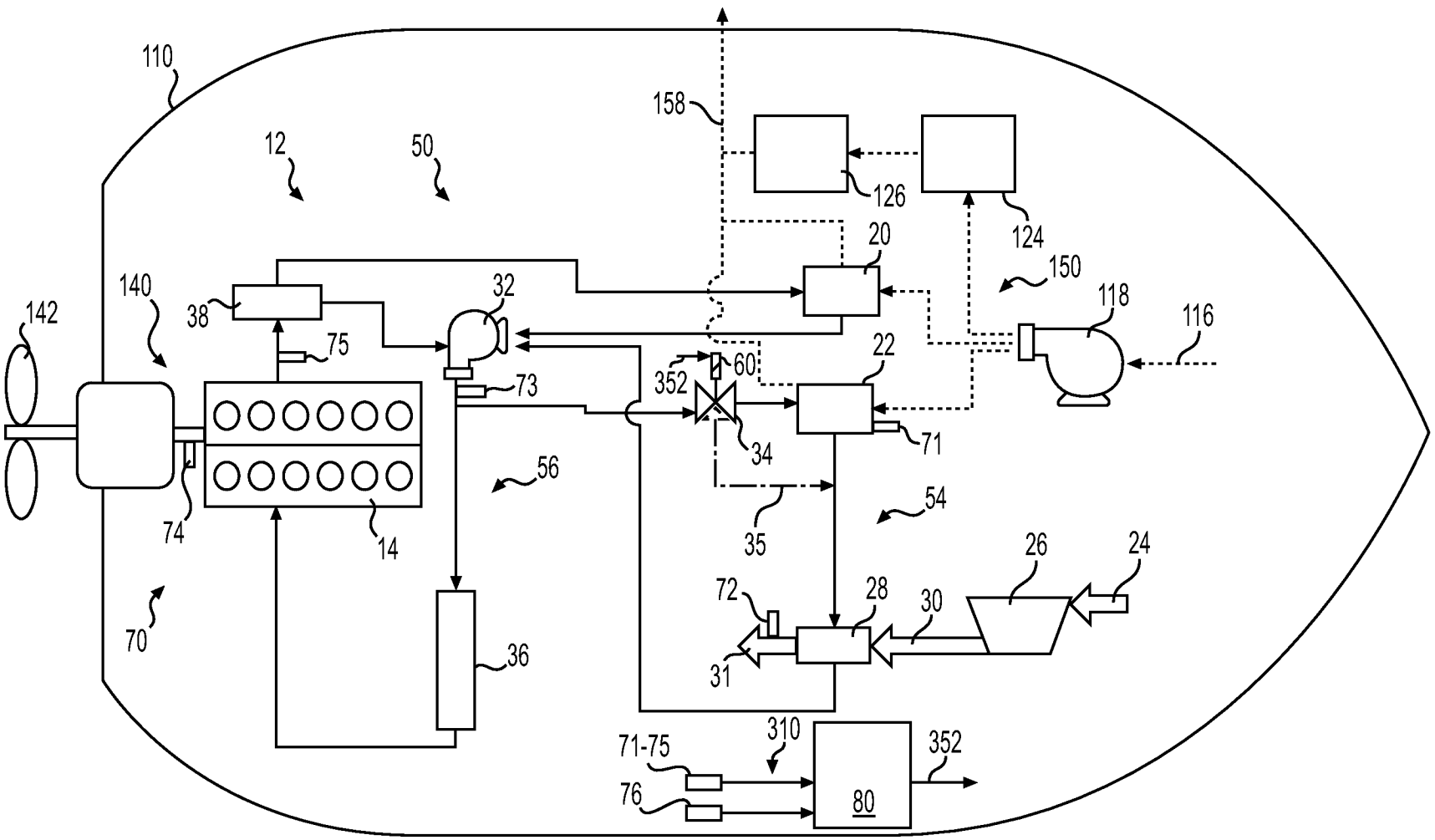
FIG. 2 is a schematic diagram of an engine system applied in a marine vessel, according to aspects of the disclosure.

FIG. 1 illustrates an exemplary engine system 12 including an internal combustion engine 14 and an engine cooling system 50 for controlling temperatures during various operating conditions of engine 14. In addition to engine 14 and cooling system 50, system 12 may include a sensor system 70 for monitoring one or more aspects of system 12 and an electronic control module ("ECM") 80 in communication with sensor system 70. Cooling system 50 may include a plurality of paths for cooling engine 14 via a jacket water cooling system and for cooling other aspects of an operating engine system, such as engine oil, gear oil, air passing within an air cooler, etc., as shown in FIGS. 1 and 2.

Engine 14 may be a diesel fuel engine, gasoline engine, gaseous fuel engine, or dual fuel engine (an engine capable of generating power by combusting liquid fuel, such as diesel or gasoline, and gaseous fuel, such as natural gas). While engine 14 is shown as a twelve-cylinder engine having two rows of cylinders, engine 14 may have fewer cylinders, more cylinders, and/or a different arrangement of cylinders. Engine 14 may be configured to receive air via an intake system that includes an air intake 24, a compressor 26, a charge air cooler 28, and an intake manifold 31. While intake manifold 31 is represented with an arrow in FIG. 1, as understood, intake manifold 31 is connected to cylinders of engine 14 to provide intake air to individual cylinders of engine 14 via a plenum and plurality of runners in a known manner. The intake air for engine 14 may be compressed with air compressor 26 (e.g., a compressor of a turbocharger, a supercharger, etc.), this compressed air being supplied to engine 14 for combustion with fuel. While one engine 14 is shown in system 12, as understood, a plurality of engines may be included in system 12, these engines being connected to cooling system 50 as shown for engine 14.

In the exemplary configuration shown in FIG. 1, cooling system 50 may include an air system cooling loop 54 and an engine system cooling loop 56. Cooling loop 54 may be a first closed loop, while cooling loop 56 may be configured as a second closed loop. These two closed loops 54 and 56 may be connected to each other and may share a single pump. For example, with loops 54 and 56 connected to each other as shown in FIG. 1, cooling system 50 may include pump 32, this pump 32 being operable to supply coolant to both closed loops 54 and 56. Loops 54 and 56 may diverge from each other via branching passages or elbows connected directly to pump 32, or connected downstream of pump 32, such that a passage of loop 54 connects pump 32 to coolant a control valve 34 (described below), while a passage of loop 56 is connected upstream of engine 14. Loops 54 and 56 may each include a component for reducing a temperature of coolant circulated within these loops, such as a jacket water heat exchanger 20 and an air cooler heat exchanger 22.

Air system cooling loop 54 may include a path for supplying coolant to one or more components of an air system that guides compressed intake air to engine 14. For example, air system cooling loop 54 may include air cooler heat exchanger 22, charge air cooler 28, a coolant pump 32, and a flow-regulating valve 34, also referred to herein as coolant control valve 34. Heat exchanger 22 may be a liquid-to-liquid heat exchanger in which coolant in loop 54 is cooled using a second fluid circulated via a circuit 18. If desired, jacket water heat exchanger 20 may also be a liquid-to-liquid heat exchanger in which coolant from loop 56 is cooled using a second fluid circulated in circuit 18. While air cooler heat exchanger 22 and jacket water heat exchanger 20 are shown connected to the same circuit 18, if desired, separate fluid circuits 18 may connect to air cooler heat exchanger 22 and jacket water heat exchanger 20. However, if desired, one or both of heat exchangers 20 and 22 may be air-to-liquid heat exchangers (e.g., radiators) that employ the flow of air to cool coolant for loops 54 and 56.

Air cooler heat exchanger 22 may be connected in loop 54 between flow-controlling valve 34 and charge air cooler 28. Heat exchanger 22 may be a liquid-to-liquid heat exchanger that reduces a temperature of coolant supplied to charge air cooler 28. Thus, coolant in loop 54 may form a first (cooled) liquid, while a separate fluid circuit 18 (dashed lines in FIG. 1) includes a second liquid that absorbs heat from the first liquid. To enable heat exchange between coolant in loop 54 and fluid in circuit 18, air cooler heat exchanger 22 may be a shell and tube heat exchanger, a plate type heat exchanger (e.g., a gasketed plate heat exchanger), or any other suitable type of heat exchanger.

Charge air cooler 28 may be connected downstream of air cooler heat exchanger 22 and upstream of coolant pump 32 in loop 54. In particular, air cooler 28 may also be connected between control valve 34 and coolant pump 32. Air cooler 28 may be an intercooler configured to cool intake air via heat exchange with coolant circulated in loop 54. As shown in FIG. 1, air cooler 28 may be connected to air compressor 26 so that charge air cooler 28 receives compressed intake air via a compressed air passage 30 connected to an outlet of compressor 26. An air outlet of air cooler 28 may be connected to engine 14 via intake manifold 31.

Pump 32 may be connected between air cooler 28 and coolant control valve 34, such that coolant is supplied to charge air cooler 28 via coolant control valve 34, this coolant returning to pump 32 from air cooler 28. With respect to loop 56, pump 32 may be connected between engine 14 and engine oil cooler 36, via a thermostat 38. Pump 32 may be a tandem pump or any other appropriate type of pump having an output sufficient to drive a sufficient quantity of coolant fluid through loops 54 and 56.

Coolant control valve 34 may be a two-way proportional valve having one inlet and one outlet, as represented by the solid line portions of valve 34 in FIGS. 1 and 2. In other configurations, valve 34 may be provided with a second outlet, represented by dashed lines in FIGS. 1 and 2, such that valve 34 is a three-way proportional valve. When valve 34 is a two-way valve, valve 34 may be positionable at a fully open position, a fully closed position, and a plurality of intermediate positions in which flow is partially restricted. When flow control valve 34 is a three-way valve having one inlet and two outlets, a bypass passage 35 may be connected to the second outlet, enabling fluid communication between valve 34 and charge air cooler 28 in a manner that bypasses air cooler heat exchanger 22. This passage 35 may be omitted in two-way configurations of valve 34. In the three-way configuration, valve 34 may have a first position that causes an entirety of the flow received by valve 34 to proceed to air cooler heat exchanger 22, and a second position that causes an entirety of the flow received at valve 34 to bypass air cooler heat exchanger 22 via bypass passage 35. Valve 34 may further include a plurality of third positions between these first and second positions. These third positions may cause some coolant to flow from valve 34 to air cooler heat exchanger 22 and some coolant to flow from valve 34 to air cooler heat exchanger 22.

Whether valve 34 is a two-way valve or a three-way valve, valve 34 may be electronically-controlled, such that the position of valve 34 is set and adjusted with an actuator 60. In an exemplary configuration, actuator 60 may be a solenoid actuator that selectively regulates a quantity of flow through air cooler heat exchanger 22. This may be performed by restricting the amount of flow through valve 34 in two-way configurations, and/or by causing at least some flow through valve 34 to bypass air cooler heat exchanger 22 in three-way configurations.

Engine system cooling loop 56 may be connected in parallel to loop 54. As shown in FIG. 1, engine system cooling loop 56 may connect pump 32 to engine 14 via an engine oil cooler 36. Engine oil cooler 36 may be connected to an outlet of pump 32 to receive coolant via pump 32, cool engine oil within cooler 36 via heat exchange, and provide this coolant to engine 14 via an outlet of cooler 36. If desired, loop 56 may also include a bypass path (not shown) in which some coolant from pump 32 bypasses cooler 36 and is delivered to engine 14. Coolant supplied to engine 14 via loop 56 may enter a water jacket of engine 14 (e.g., a sealed coolant path adjacent to cylinders of engine 14, where the coolant receives heat from engine 14).

A thermostat 38 may be connected downstream of engine 14 to receive the coolant from engine 14. Thermostat 38 may include a plurality of outlets, including a first outlet connected to jacket water heat exchanger 20, and a second outlet connected to pump 32. Thermostat 38 may be a mechanically-regulated valve configured to partially or fully close one of these outlets based on the temperature of the coolant exiting engine 14. Thermostat 38 may define a plurality of coolant paths: a path in which coolant from thermostat 38 is provided to pump 32 via jacket water heat exchanger 20, and another path in which coolant from thermostat 38 bypasses jacket water heat exchanger 20. Thus, and as shown in FIG. 1, jacket water heat exchanger 20 may be connected between thermostat 38 and pump 32 in loop 56.

Figure 3:
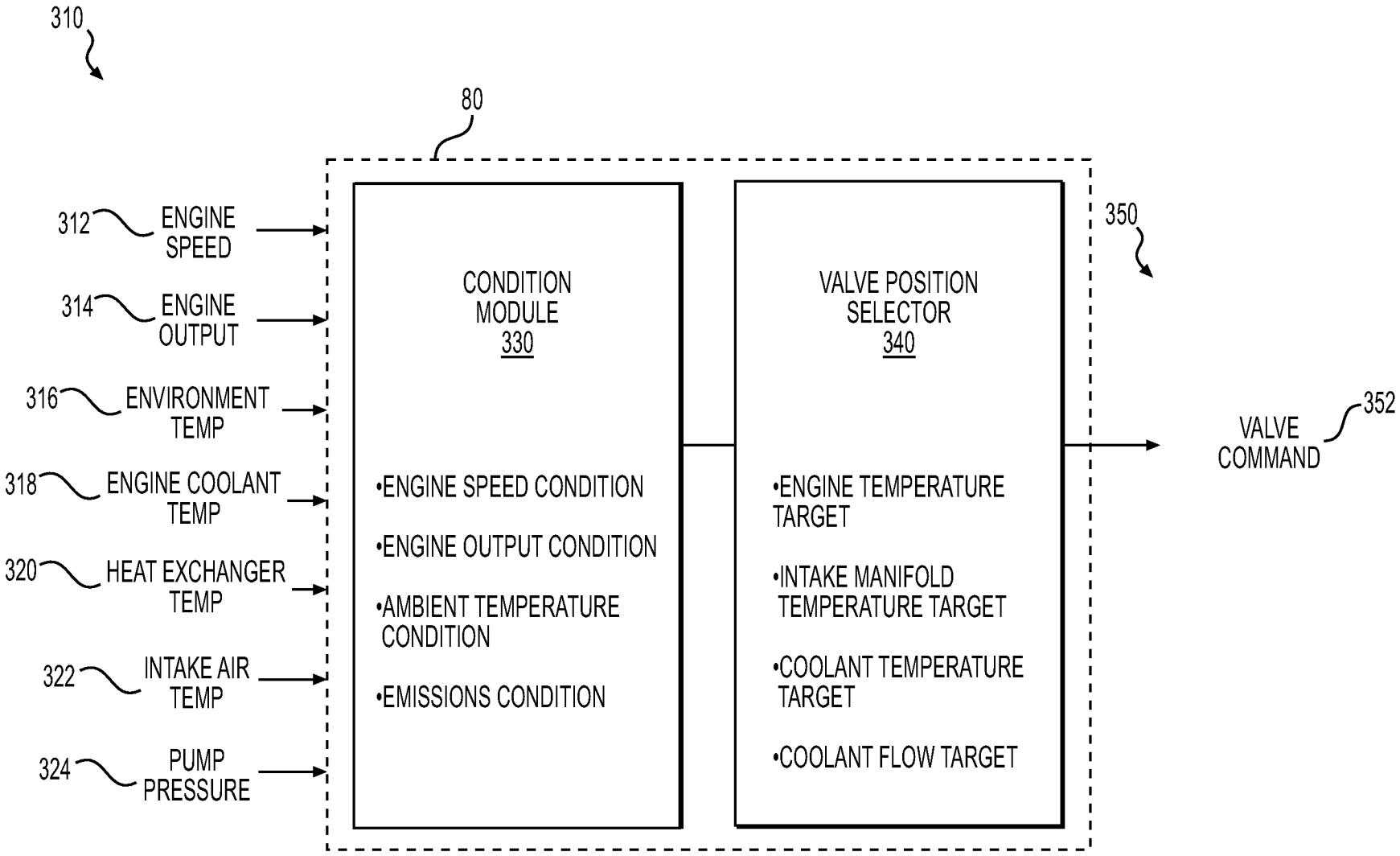
FIG. 3 is a block diagram of an electronic control module that may be used with an electronically-actuated flow valve, according to aspects of the disclosure.

Sensor system 70 may be configured to monitor aspects of system 12, including one or more signals that may be useful for controlling valve 34 and for determining conditions of system 12 and engine 14. Sensor system 70 may include at least one sensor in communication with ECM 80, such as a heat exchanger temperature sensor 71 to measure a temperature of coolant entering and/or exiting heat exchanger 22, an intake manifold sensor 72 configured to measure intake manifold temperature ("IMT"), intake manifold air pressure ("IMAP"), or both IMT and IMAP, a pump pressure sensor 73 configured to detect a pressure associated with pump 32, an engine sensor 74 (e.g., an engine speed sensor, engine fuel sensor, etc.), a jacket water temperature sensor 75 configured to measure coolant temperature, and an ambient temperature sensor 76 configured to detect an ambient temperature associated with system 12, such as a temperature outside of system 12 or around system 12. The sensors of sensor system 70 may be configured to generate signals that are received by ECM 80 as inputs 310 (FIGS. 1-3). While the sensors of sensor system 70 are shown at exemplary locations in FIG. 1, as understood, one or more of these sensors may be secured at a different position. For example, while jacket water temperature sensor 75 is shown at a position downstream of engine 14, jacket water temperature sensor 75 may include one or more temperature sensors upstream of engine 14, either instead of or in addition to the downstream position illustrated in FIG. 1.

ECM 80 may be enabled, via programming, to generate outputs (e.g., commands 352 for actuator 60) that control and adjust a position of coolant control valve 34 based on one or more conditions of system 12. In particular, ECM 80 may be configured to identify one or more conditions associated with internal combustion engine 14 and determine one or more suitable temperature targets (values or ranges) for the operating condition, as described below. Commands 352 generated with ECM 80 may adjust the position of valve 34 so as to modify the proportion of coolant that passes through air cooler heat exchanger 22 and thereby seek a temperature target at one or more other locations of system 12.

ECM 80 may be a control unit for controlling internal combustion engine 14 (e.g., by issuing commands to one or more fuel injectors), or may be a separate control unit that is dedicated for monitoring and controlling system cooling. If desired, ECM 80 may be in communication with one or more additional electronic control modules, including a supervisory control module, a control module for a transmission system, or a control module that controls fuel injectors of engine 14. ECM 80 may embody a single microprocessor or multiple microprocessors that receive inputs 310 and generate outputs 350 (FIG. 3). ECM 80 may include a memory, a secondary storage device, a processor such as a central processing unit, or any other means for accomplishing a task consistent with the present disclosure. The memory or secondary storage device associated with ECM 80 may store data and software to allow ECM 80 to perform its functions, including the condition module 330 and valve position selector 340 functions described with respect to FIG. 3 and one or more steps of method 400 described below. Numerous commercially available microprocessors can be configured to perform the functions of ECM 80. Various other known circuits may be associated with ECM 80, including signal-conditioning circuitry, communication circuitry, and other appropriate circuitry.

FIG. 2 illustrates an embodiment of engine system 12 in which system 12 is utilized in a marine vessel such as a ship 110. Ship 110 may be, for example, a tugboat, a cargoship or freighter, a yacht, a fishing boat, a passenger boat (e.g., a ferry), a patrol or emergency response boat, or any other type of recreational or commercial boat. In addition to the components described above with respect to FIG. 1, system 12 may include components suitable for use in a marine environment. For example, system 12 may include a seawater supply 150 forming one or more open-loop circuits that can supply cooling seawater to a fuel cooler 124, and gear oil cooler 126, as well as to jacket water heat exchanger 20 and air cooler heat exchanger 22. An outlet 158 may provide a path for seawater to exit system 12. Ship 110 may also include a propulsion device 142 connected to engine 14 via a coupling 140. Coupling 140 may include one or more flywheels, gearboxes, clutches, couplings, and/or transmission shafts, in a known manner. Ship 110 may also include one or more internal combustion engines 14 used as part of a generator set (not shown), a system which is not connected to a propulsion device 142 and that includes a generator in combination with engine 14.

In the exemplary configuration shown in FIG. 2, cooling system 50 includes seawater supply 150 represented with dashed lines, air system cooling loop 54, and engine system cooling loop 56. In this configuration, cooling system 50 may include no more than two pumps, a pump that supplies seawater (e.g., pump 118 of the open loop formed by seawater supply 150), and a pump that supplies coolant (e.g., pump 32 of loops 54 and 56). Moreover, the fluid supplied by these pumps 32 and 118 does not mix such that coolant within the closed loops 54 and 56 may be isolated from seawater in supply 150.

Seawater supply 150 of cooling system 50 may include a plurality of parallel paths configured to receive fluid, such as seawater, and pass this seawater through heat exchangers to draw heat away from coolant and from one or more components of engine system 12. Seawater supply 150 may include a water intake 116 configured to connect a seawater pump 118 to a source of water (e.g., a body of water in which ship 110 is floating). Seawater pump 118 may include one or more outlets that supply this seawater to fuel cooler 124, gear oil cooler 126, jacket water heat exchanger 20, and air cooler heat exchanger 22. This cooling seawater, after passing through one or more of these components, may exit ship 110 via ship outlet 158. While a single outlet 158 is shown in FIG. 1, as understood, ship 110 may include two more outlets 158, each path of seawater supply 150 including one or more individual outlets 158 to facilitate efficient routing of seawater supply 150.

A first path of seawater supply 150 may include water intake 116, pump 118, fuel cooler 124, gear oil cooler 126, and outlet 158. Fuel cooler 124 may include a heat exchange device in which fuel (e.g., fuel returning to a fuel tank from engine 14) is cooled by seawater pumped via seawater pump 118. Another heat exchange device, gear oil cooler 126, may be connected downstream of fuel cooler 124, or alternatively, in parallel with or downstream of fuel cooler 124. Gear oil cooler 126 may be configured to cool oil for one or more transmission components (e.g., a gearbox of coupling 140) with seawater delivered via water pump 118.

A second path of seawater supply 150 may provide a flow of seawater to a cooling device associated with engine 14. This path of seawater supply 150 may include water intake 116, seawater pump 118, heat exchanger 20, and outlet 158. Seawater may enter an inlet of jacket water heat exchanger 20, absorb heat from engine coolant passing within jacket water heat exchanger 20, and exit jacket water heat exchanger 20. Seawater that exits heat exchanger 20 may be removed from ship 110 via outlet 158.

A third path of seawater supply 150 may connect seawater pump 118 to air cooler heat exchanger 22. This third path may include water intake 116, seawater pump 118, air cooler heat exchanger 22, and outlet 158. Air cooler heat exchanger 22 may include a seawater inlet connected to seawater pump 118 and an outlet for seawater connected to ship outlet 158.

FIG. 3 is a block diagram of an exemplary configuration of ECM 80 that may enable functions for controlling cooling of engine 14 according to one or more different conditions of system 12. ECM 80 may receive inputs 310, generate one or more outputs 350, with one exemplary output 352 being shown. ECM 80 may include (e.g., ECM 80 may be programmed with) a condition module 130 configured to evaluate conditions of system 12 based on one or more inputs 310 and a valve position selector 340 configured to generate valve commands 352 based on the conditions identified with conditions module 130.

The inputs 310 received by ECM 80 may include signals from sensor system 70. Inputs 310 may also include one or more calculated values, if desired. As shown in FIG. 3, inputs 310 may include an engine speed signal 312, an engine output signal 314, an environment temperature signal 316, an engine coolant temperature signal 318, a heat exchanger temperature signal 320, an intake air temperature signal 322, and a pump pressure signal 324.

Engine speed signal 312 may be a signal generated by engine sensor 74 (FIGS. 1 and 2) that represents a detected speed of engine 14. In particular, engine speed signal 312 may represent a detected speed and/or detected position of a crankshaft or other output shaft connected to engine 14. Engine output signal 314 may be a calculated or detected value representing torque or power output of engine 14. This engine output may be determined based on an amount or pressure of air supplied to engine 14 (as measured with intake manifold sensor 72), a quantity or pressure of fuel supplied to engine 14 (calculated based on fuel injector commands and/or one or more sensors associated with a fuel delivery system), and/or the speed of engine 14 represented by engine speed signal 312. Environment temperature signal 316 may represent an ambient temperature of the geographic location of system 12 generated with ambient temperature sensor 76. In configurations where system 12 is adapted for a marine vessel, temperature signal 316 may indicate a temperature of a body of water or a temperature at a body of water. Engine coolant temperature signal 318 may represent a temperature of coolant in loop 56 and may be generated by jacket water temperature sensor 75. Heat exchanger temperature signal 320 may be generated by heat exchanger temperature sensor 71, and may indicate the temperature of coolant supplied to heat exchanger 22, and in particular, the temperature of coolant at an inlet of heat exchanger 22. Intake air temperature signal 322 may represent the temperature of compressed air supplied to engine 14 (e.g., downstream of a compressor and downstream of charge air cooler charge air cooler 28), as measured with intake manifold sensor 72. Pump pressure signal 324 may represent a pressure of pump 32, and in particular, a pressure difference between an inlet of pump 32 and an outlet of pump 32 (e.g., inlets and outlets of pump 32 for loops 54 and/or 56).

Condition module 330 may be configured to determine one or more types of conditions associated with system 12 and engine 14. The condition(s) identified with condition module 330 may depend on the particular configuration of system 12 (e.g., whether system 12 is placed on a stationary machine, mobile machine, vehicle, or marine vessel). In the example of a vehicle or machine (e.g., an earthmoving machine, off-highway truck, material loaders, etc.), condition module 330 may be configured to determine engine speed conditions and engine output conditions. In the example of a marine vessel such as ship 110, condition module 330 may be configured to determine ambient temperature conditions or emissions conditions, instead of or in addition to engine speed conditions and engine output conditions. However, it is also contemplated that a vehicle or machine may also include a condition module 330 configured to determine ambient temperature and emissions conditions. The conditions determined with module 330 may be output to valve positon selector 340 and used to generate valve command 352.

An engine speed condition determined with condition module 330 may indicate whether the current engine speed signal 312 indicates a low speed condition (e.g., an engine speed that is equal to or lower than a first predetermined speed), a high speed condition (e.g., an engine speed that is equal to or higher than a second predetermined speed, the second predetermined speed being faster than the first predetermined speed), or a moderate speed condition (e.g., an engine speed between the first and second predetermined speeds). The engine speed may correspond to a speed of a crankshaft of engine 14. In some aspects, the high engine speed may be approximately equivalent to the rated engine speed of engine 14.

When an engine output condition is determined with module 330, this condition may indicate whether the current output of engine 14 is high, moderate, or low, based on low and high predetermined thresholds, in a similar manner as described above with respect to engine speed conditions. The engine output may correspond to torque generated with engine 14 or a power generated with engine 14. In some aspects, the high engine output may be approximately equivalent to the rated, or maximum, output (power or torque) of engine 14.

When condition module 330 determines an ambient temperature condition, this condition may correspond to whether the current temperature (e.g., a temperature indicated by environment temperature signal 316) corresponds to a standard or typical day-time temperature, a low ambient temperature, or a high ambient temperature. The low ambient temperature condition may correspond to temperatures below a low temperature threshold, while the high ambient temperature condition may correspond to temperatures above a high temperature threshold.

In aspects where condition module 330 determines an emissions condition, this condition may correspond to a reduced-emissions mode or a normal mode. In some aspects, the emissions condition may correspond to a manual or automated request for reduced emissions. The reduced emissions mode may be suitable for marine applications of system 12 (e.g., ship 110) where emissions requirements may change according to the location of system 12. For example, ECM 80 may receive a request for reduced emissions when system 12 is located within a particular distance of a port.

Valve position selector 340 may receive one or more of the above-described conditions determined with condition module 330. Valve position selector 340 may also be configured to determine one or more target temperatures that are appropriate for the received conditions. For example, valve position selector 340 may determine temperature targets, in the form of either a particular temperature or range of temperatures for one or more of: internal combustion engine 14, intake manifold, or coolant between engine 14 and pump 32. If desired, valve position selector 340 may also be configured to set one or more flow targets, such as a flow rate of coolant through engine 14.

The target temperature(s) set with valve position selector 340 may be lower for determined conditions that are associated with lower engine speed, lower output, and/or lower ambient temperatures. While the target temperature may be set based on a single condition, the target temperature may be set by taking into account multiple determined conditions. In one example, an IMT target may be set based on engine speed, engine power, and ambient temperature conditions, with lower engine speeds, lower engine powers, and lower ambient temperatures acting to decrease the IMT target, while higher engine speeds, higher engine powers, and higher ambient temperatures increase the IMT target. ECM 80 may be configured to determine whether a temperature target is satisfied based on feedback information from signals 318, 320, and 322. When a flow target is set with ECM 80, pump pressure 324 may provide feedback information to assist ECM 80 in determining whether the flow target is satisfied.

Valve position selector 340 may be able to determine an appropriate position for valve 34, and generate commands 352 for actuator 60. These commands may be based on the condition determined with module 330 and, in particular, may seek to achieve the above-described targets. Valve position selector 340 may generate bypass valve command 352 to adjust the position of valve 34 by controlling an amount of electrical energy supplied to actuator 60, this position controlling the amount of coolant that enters heat exchanger 22 and thereby controlling the temperature of components cooled by loops 54 and 56. Bypass valve command 352 may control the amount of current supplied to a solenoid of actuator 60, a duty cycle of energy supplied to this solenoid, or both, such that valve 34 enters a desired position based on the above-described temperature target(s).

In some aspects, the valve command 352 generated with valve position selector 340 may cause valve 34 to be in a "fully open" position in which no coolant bypasses heat exchanger 22 when the engine speed condition or the engine output condition is high, thereby maximizing cooling. When engine speed and engine output are both low, valve position selector 340 may cause valve 34 to be in a "fully closed" position in which substantially no coolant is provided to heat exchanger 22. When engine speed and engine output conditions are both moderate or low, the valve command 352 determined with position selector 340 may be adjusted based on the ambient temperature condition, the emissions condition, or both.

INDUSTRIAL APPLICABILITY

Engine system 12 may be useful in any machine, vehicle, or marine vessel (e.g., ship 110) having an internal combustion engine, where it is desirable to control cooling of one or more system components based on changing operating conditions. Engine system 12 may be useful to control engine cooling in a manner that accounts for various conditions that occur in mobile or stationary machines, vehicles, and/or marine vessels. In particular, engine system 12 may be useful for controlling cooling in systems 12 that include an engine coolant loop and an air cooler coolant loop, coolant being driven through these loops by a single pump.

Figure 4:
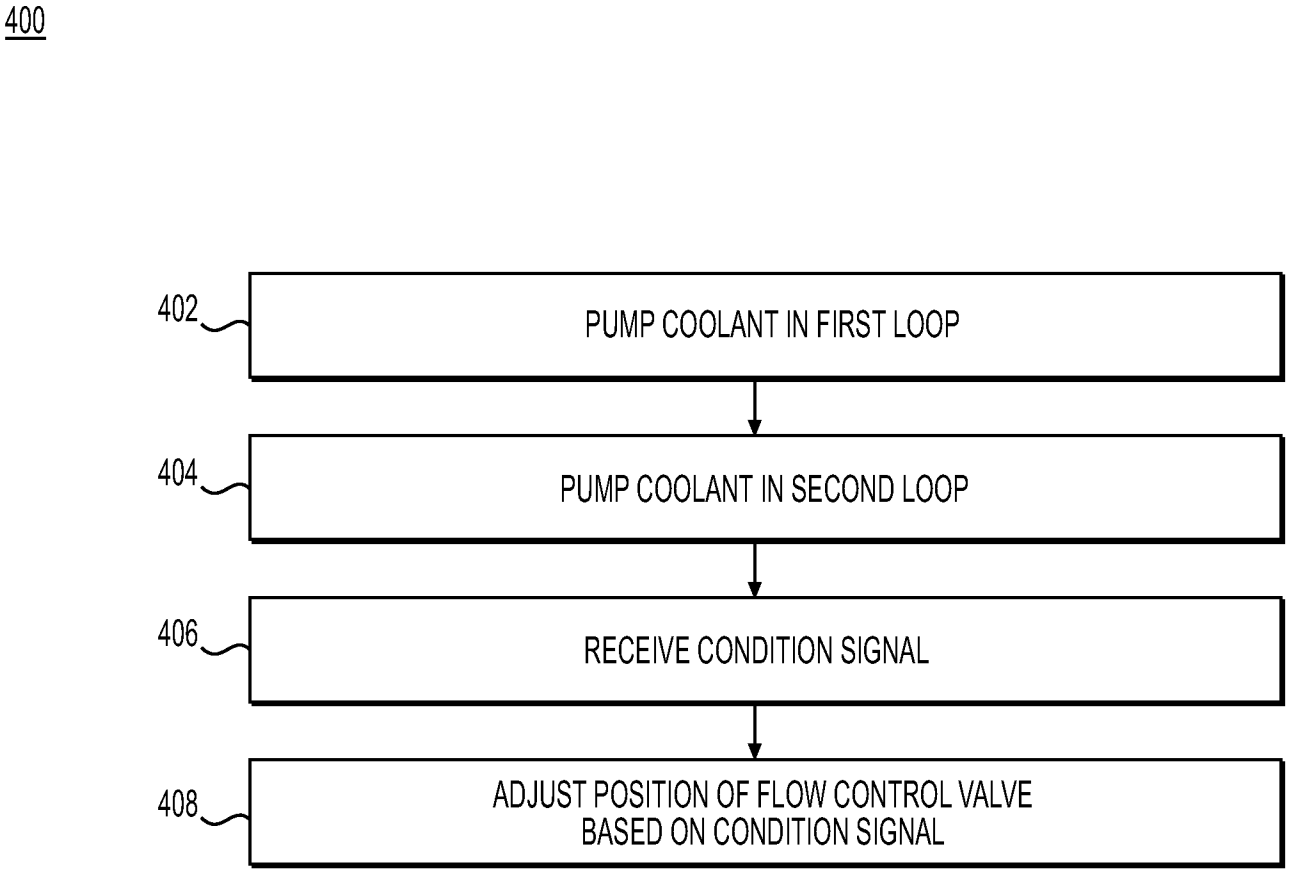
FIG. 4 is a flowchart depicting an exemplary method for controlling an internal combustion engine cooling system, according to aspects of the disclosure.

FIG. 4 is a flowchart illustrating an exemplary method 400 for controlling a cooling system, such as cooling system 50, associated with internal combustion engine 14, according to aspects of the present disclosure. Method 400 may be performed while operating engine 14 to generate propulsion or electrical power for ship 110, a mobile machine, or a vehicle. Method 400 may also be performed when system 12 is employed in a stationary power generation configuration. Method 400 may be performed continuously during the operation of system 12, or in response to a particular condition or to condition changes.

A step 402 of method 400 may include pumping, with pump 32, coolant in a first closed loop, such as loop 56, for supplying this coolant to internal combustion engine 14. The coolant may pass through engine oil cooler 36, or may bypass engine oil cooler 36 via a bypass passage (not shown), and may be received within an interior of engine 14. For example, a block of engine 14 may include a water jacket, such that the coolant flows through this jacket and adjacent to one or more cylinders of engine 14. The coolant may return to pump 32 via thermostat 38, either through a path that includes jacket water heat exchanger 20 or a path that bypasses jacket water heat exchanger 20. The path by which coolant returns to pump 32 may depend on the temperature of the coolant. For example, when coolant has a relatively low temperature, thermostat 38 may cause coolant to return directly to pump 32. However, when coolant exiting engine 14 has a relatively high temperature, some or all of this coolant may be directed, via thermostat 38, to jacket water heat exchanger 20, where the coolant is cooled via heat exchange with a second fluid (e.g., seawater circulated in seawater supply 150, as represented with dotted lines in FIG. 2).

A step 404 may include pumping coolant in a second loop, such as loop 54, with pump 32. Pumping coolant in loop 54 may supply coolant to a system that guides air (e.g., compressed air) to engine 14. This coolant may be the same as the coolant that is pumped with pump 32 in step 402. Thus, steps 402 and 404 may include pumping coolant with a single pump, such that the engine system 12 includes exactly one coolant pump for the closed-circuit coolant loops for engine 14 and air cooler 28. Step 404 may also include supplying this coolant to bypass valve 34.

A step 406 may include receiving condition signals and determining conditions associated with system 12 based on the received signals. For example, condition module 330 may determine one or more of an engine speed condition, an engine output condition, an ambient temperature condition, or an emissions condition, as described above. The conditions determined in step 406 may be based on sensor signals and/or calculated values, such as engine speed signal 312, engine output signal 314, and environment temperature signal 316. In step 406, condition module 330 may determine whether engine speed or engine power is high (e.g., approximately equal to the rated speed or power of engine 14), moderate, or low, as described above. When ambient conditions are determined in step 406, condition module 330 may determine whether the ambient temperature corresponds to typical daytime ambient temperatures or whether the temperature is lower or higher than typical ambient daytime temperatures.

Step 408 may include operating valve 34 in response to the determination performed in step 406. In particular, step 408 may include setting or adjusting a position of flow control valve 34 based on the condition signal received in step 406. Step 408 may include generating a command valve command 352 to control a state of actuator 60.

The adjusted position of valve 34 may be based on the engine speed condition, engine output condition, ambient temperature condition, emissions condition, or any combination of these conditions. In some aspects, the adjusted position of valve 34 may reflect all of these conditions, with the engine speed and engine output conditions having the greatest impact on command 352. For example, when engine speed and/or engine output is high, the ambient temperature condition and/or emissions condition may be ignored and valve 34 may be set to a fully-open position in which no flow bypasses heat exchanger 22.

In conditions when engine speed and engine output are each moderate or low, the ambient temperature condition, emissions condition, or both, may be used to further adjust command 352. For example, if engine speed and/or engine output are both moderate and ambient temperature is moderate, valve 34 may be set to a position where approximately 50% of the flow of coolant bypasses heat exchanger 22, while the remaining 50% of flow is directed to heat exchanger 22. In conditions where engine speed and/or engine output are both moderate and ambient temperature is high, valve 34 may be set to a position where approximately 25% of the coolant bypasses heat exchanger 22, while the remaining approximately 75% of the coolant is directed to heat exchanger 22. When engine speed, engine output, and ambient temperature are all low, valve 34 may be fully closed such that no coolant is directed to heat exchanger 22.

Command 352 may also be adjusted in a manner that is expected to reduce emissions produced by engine 14 when ECM 80 receives a request to enter a reduced emissions mode. For example, command 352 may be adjusted to increase a flow of coolant to heat exchanger 22 when increased cooling will result in improved emissions performance of engine 14.

While steps 402, 404, 406, and 408 have been described in an exemplary sequence, as understood, one or more of these steps may be performed simultaneously or performed and/or repeated in a different order. Moreover, any two or more of these steps may be performed simultaneously and/or at overlapping periods of time. In embodiments where valve 34 is a two-way valve, the above-described exemplary positions of valve 34 may be employed to adjust the flow of coolant to heat exchanger 22 when desired, without causing coolant to bypass heat exchanger 22 due to the omission of a second outlet and/or bypass passage 35. For example, rather than causing 25% of coolant to bypass heat exchanger 22, valve 34 may instead restrict flow rate by a corresponding amount (e.g., 25%).

System 12 and method 400 may be useful for various types of internal combustion engines 14. In particular, system 12 and method 400 may provide coolant flow to both a jacket water system and a separate circuit after cooler system via respective closed coolant loops and a single pump. System 12 and method 400 may further facilitate control over system temperatures under different operating conditions. This control may improve control over emissions and improve compensation for ambient conditions, such as ambient temperature. Additionally, the use of a single pump for both engine and air cooler circuits may reduce cost, system complexity, and space requirements.

It will be apparent to those skilled in the art that various modifications and variations can be made to the disclosed system and method without departing from the scope of the disclosure. Other embodiments of the system and method will be apparent to those skilled in the art from consideration of the specification and system and method disclosed herein. It is intended that the specification and examples be considered as exemplary only, with a true scope of the disclosure being indicated by the following claims and their equivalents.

What is claimed is:

1. A method for controlling an internal combustion engine cooling system, the method comprising:

pumping coolant in an engine cooling loop with a coolant pump;

pumping the coolant in an air cooler loop that includes a liquid-to-liquid heat exchanger with the coolant pump;

receiving a condition signal indicative of at least one condition associated with the internal combustion engine; and based on the condition signal, adjusting a position of a flow control valve to modify a flow of coolant to the liquid-to-liquid heat exchanger.

2. The method of claim 1, wherein the condition signal represents an engine speed or an engine output.

3. The method of claim 1, wherein the condition signal represents an ambient temperature or an emissions condition.

4. The method of claim 1, wherein the position of the flow control valve is adjusted to seek a target temperature associated with the internal combustion engine, an intake manifold, or coolant present between the internal combustion engine and the coolant pump.

5. The method of claim 1, wherein the position of the flow control valve is adjusted to a fully open position based on the condition signal indicating that an engine speed is approximately equal to a rated speed of the internal combustion engine or that an engine output is approximately equal to a rated output of the internal combustion engine.

6. The method of claim 1, wherein, when the internal combustion engine operates at an engine speed that is less than a maximum speed and greater than a minimum speed, the position of the flow control valve is adjusted based on an ambient temperature.

7. The method of claim 1, wherein the coolant pump is a single pump that receives the coolant from the engine cooling loop and the coolant from the air cooler loop.

8. A method for controlling a cooling system for an internal combustion engine, the method comprising:

pumping coolant in a first closed loop and a second closed loop, the first and second closed loops being connected to each other and to a single coolant pump, the first closed loop including an air cooler;

determining a condition associated with the internal combustion engine, including one or more of an engine speed condition, an engine output condition, an ambient temperature condition, or an emissions condition; and in response to the determined condition, adjusting a position of a coolant flow valve positioned in the first closed loop.

9. The method of claim 8, further including determining one or more target temperatures based on the determined condition.

10. The method of claim 9, wherein the one or more target temperatures include a target temperature range associated with the internal combustion engine, the coolant, or an intake manifold.

11. The method of claim 10, wherein the condition associated with the internal combustion engine is the ambient temperature condition.

12. The method of claim 10, wherein the air cooler is connected between a liquid-to-liquid heat exchanger and the coolant pump.

13. An internal combustion engine cooling system, comprising:

an internal combustion engine;

a single coolant pump in fluid communication with an engine cooling loop connected to provide coolant to the internal combustion engine and an air system cooling loop connected to provide the coolant to an air cooler;

a liquid-to-liquid heat exchanger configured to receive the coolant via the coolant pump; and a flow control valve connected downstream of the coolant pump as part of the air system cooling loop, the flow control valve being configured to modify a flow of the coolant from the engine cooling loop to the liquid-to-liquid heat exchanger based on one or more operating conditions of the internal combustion engine.

14. The system of claim 13, further comprising an electronic control module configured to control the flow control valve based on the one or more operating conditions of the internal combustion engine.

15. The system of claim 14, wherein the electronic control module is configured to adjust a position of the flow control valve based on an engine speed, an engine output, or an emissions condition associated with the internal combustion engine.

16. The system of claim 13, wherein the cooling system is secured on a marine vessel having a seawater supply and a heat exchanger configured to cool the coolant with the seawater supply.

17. The system of claim 16, further comprising an ambient temperature sensor configured to detect an ambient temperature associated with the internal combustion engine, the flow control valve being configured to adjust based on the ambient temperature detected with the ambient temperature sensor.

18. The cooling system of claim 13, further comprising an electronic control module configured to adjust the flow control valve in response to a change in an operating condition of the internal combustion engine to control an intake manifold temperature.

19. The system of claim 13, wherein the liquid-to-liquid heat exchanger is connected downstream of the coolant pump and upstream of an air cooler.

20. The system of claim 19, wherein the liquid-to-liquid heat exchanger is connected in the air system cooling loop and in communication with the engine cooling loop to reduce a temperature of the coolant provided to the air cooler and the temperature of the coolant provided to the internal combustion engine.

* * * * *